US008776537B2

(12) United States Patent
Sullivan

(10) Patent No.: US 8,776,537 B2
(45) Date of Patent: Jul. 15, 2014

(54) VECTOR COMPONENT FOR AN AIR-CONDITIONING SYSTEM

(75) Inventor: Shaun E. Sullivan, Salem, OR (US)

(73) Assignee: Spin Energy Corporation, Salem, OR (US)

( * ) Notice: Subject to any disclaimer, the term of this patent is extended or adjusted under 35 U.S.C. 154(b) by 372 days.

(21) Appl. No.: 12/898,488

(22) Filed: Oct. 5, 2010

(65) Prior Publication Data

US 2011/0079041 A1 Apr. 7, 2011

Related U.S. Application Data

(60) Provisional application No. 61/248,974, filed on Oct. 6, 2009.

(51) Int. Cl.
*F25B 1/00* (2006.01)

(52) U.S. Cl.
USPC ..... 62/115; 62/498

(58) Field of Classification Search
CPC ..... F25B 41/062; F25B 49/022; F25B 1/00; F25B 1/10; F25B 13/00; F25B 9/008; F25B 2339/041; F25B 39/04; F25D 5/02
USPC ..... 62/115, 498, 196.4, 513, 238.6, 305; 165/104.26
See application file for complete search history.

(56) References Cited

U.S. PATENT DOCUMENTS 3,838,582 A * 10/1974 Redfern et al. ..... 62/196.4
4,019,341 A * 4/1977 Iwasaki ..... 62/277
4,023,377 A * 5/1977 Tomita ..... 62/196.4
4,176,526 A * 12/1979 Missimer ..... 62/278
4,318,277 A * 3/1982 Cann et al. ..... 62/278
5,046,325 A * 9/1991 Kuwahara ..... 62/156
5,297,397 A * 3/1994 Pointer ..... 62/238.6
5,553,463 A * 9/1996 Pointer ..... 62/238.6
6,446,462 B1 * 9/2002 Kiyokawa et al. ..... 62/469
6,467,303 B2 * 10/2002 Ross ..... 62/509
6,494,051 B2 * 12/2002 Sakakibara et al. ..... 62/225
7,197,889 B2 * 4/2007 Wakatsuki et al. ..... 62/196.4
7,228,705 B2 * 6/2007 Harm ..... 62/434
7,438,539 B2 * 10/2008 Kohsokabe et al. ..... 418/55.6
2002/0071773 A1 * 6/2002 Matsuba et al. ..... 417/310
2003/0136136 A1 * 7/2003 Nomura et al. ..... 62/136
2003/0213261 A1 * 11/2003 Hebert ..... 62/277
2006/0053651 A1 * 3/2006 Tadano et al. ..... 34/74
2006/0096308 A1 * 5/2006 Manole ..... 62/277

* cited by examiner

*Primary Examiner* — Mohammad M Ali
(74) *Attorney, Agent, or Firm* — Lee & Hayes, PLLC

(57) ABSTRACT

Systems, methods, and devices are described for implementing and/or utilizing a vector component within an air-conditioning (a/c) system. In one embodiment, the vector component may be situated between a compressor and a condenser of the a/c system. Moreover, the vector component may receive a superheated vapor from the compressor and route the superheated vapor into one or more capillary tubes. The superheated vapor may be cooled to a liquid by exposing the superheated vapor to a sub-cooled liquid. The liquid may then be transferred to the condenser. Additionally, at least a portion of the sub-cooled liquid may be heated to a saturated vapor and routed back to the compressor, where the above process may be repeated.

18 Claims, 3 Drawing Sheets

VECTOR COMPONENT FOR AN AIR-CONDITIONING SYSTEM

CROSS-REFERENCE TO RELATED APPLICATIONS

This patent application claims priority to commonly-owned U.S. Patent Provisional Application No. 61/248,974, entitled "Vector-Component Technology", and filed on Oct. 6, 2009, which application is incorporated herein in its entirety by reference.

BACKGROUND

Vapor-compression refrigeration is one of many different refrigeration cycles available for use. Vapor-compression refrigeration has been commonly used in air-conditioning (a/c) systems, which are typically used in commercial buildings, private residences, and both domestic and commercial refrigerators, for example. In such environments, vapor cycle a/c systems assist in lowering the temperature of an enclosed space by removing heat from that space and transferring the heat elsewhere. The vapor cycle a/c system may lower the temperature of an enclosed space by circulating a working fluid, such as a liquid refrigerant, through a plurality of components of the vapor cycle a/c system. As the working fluid passes through these components, the working fluid serves as a medium to absorb and/or remove heat from the space to be cooled and subsequently expels the removed heat to a different space. However, although the space to be cooled may have its temperature lowered, the manner in which the vapor cycle a/c system cools this enclosed space is frequently inefficient.

SUMMARY

Described herein are techniques for incorporating a vector component into an air-conditioning (a/c) system. In various embodiments, a system may include a compressor, a condenser, an expansion system, an evaporator, and a vector component situated between the compressor and the condenser. The compressor may receive a saturated vapor or vapor and compress the saturated vapor or vapor to form a compressed, superheated vapor. Subsequently, the superheated vapor may be discharged from the compressor and directed to the vector component. Upon receipt of the superheated vapor, the vector component may route the superheated vapor into one or more capillary tubes. Moreover, a sub-cooled liquid within the vector component may cool the superheated vapor so that the superheated vapor may be converted to a liquid and discharged from the vector component. Additionally, based in part on the heat transfer from the superheated vapor to the sub-cooled liquid, at least a portion of the sub-cooled liquid may be heated to a saturated vapor. As a result, the liquid and the saturated vapor may exit the vector component and then be routed to the condenser and the compressor, respectively. Incorporation of the vector component within an a/c system may increase the efficiency of, and/or decrease the costs associated with manufacturing and/or maintaining, an a/c system.

This Summary is provided to introduce a selection of concepts in a simplified form that is further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The detailed description is set forth with reference to the accompanying figures, in which the left-most digit of a reference number identifies the figure in which the reference number first appears. The use of the same reference numbers in the same or different figures indicates similar or identical items or features.

DETAILED DESCRIPTION

Figure 1:
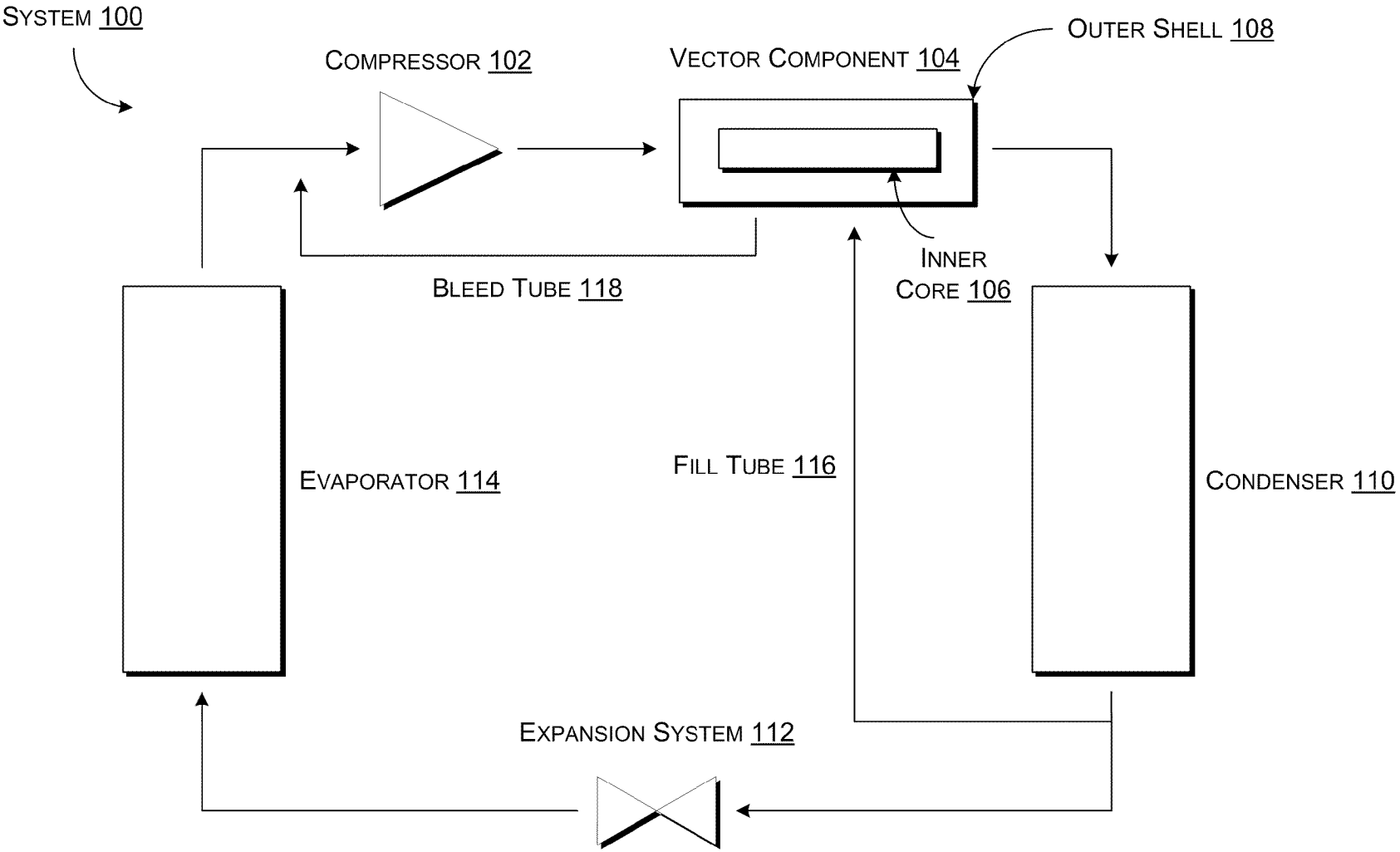
FIG. 1 illustrates a block diagram of an air-conditioning (a/c) system including a vector component, in accordance with various embodiments.

Described herein are systems and/or techniques for incorporating a vector component into an air-conditioning (a/c) system, such as a vapor cycle a/c system, to increase the efficiency of the a/c system. As stated above, a vapor cycle a/c system includes a plurality of different components. For instance, a vapor cycle a/c system typically includes a compressor, a condenser, an expansion system, and an evaporator. Initially, working fluid that circulates through the system may enter the compressor in a thermodynamic state known as a saturated vapor or vapor. The saturated vapor/vapor may be a heat-laden gas having a relatively low pressure. Upon entering the compressor, the saturated vapor or vapor may be compressed to a higher pressure, resulting in an increased temperature of the saturated vapor or vapor. In some instances, the saturated vapor or vapor may be compressed at a constant entropy that converts the saturated vapor or vapor into a superheated vapor having an increased energy.

Following compression of the saturated vapor or vapor by the compressor, the hot, compressed vapor (also referred to as a "superheated vapor") may be at a temperature and pressure at which it may be condensed by exposing the compressed vapor to cooling water or cooling air. The high-pressure, high-temperature vapor may then be passed to the condenser, where it may be cooled to a liquid state. More particularly, the compressed vapor that exited the compressor may be routed through a coil or tubes within the condenser. While in the coil or tubes, the compressed vapor may be condensed into a liquid by flowing cool air or cool water across the coil or tubes. In various embodiments, this liquid may be referred to as a "sub-cooled liquid." During this process, the heat may be absorbed and/or removed by the cool air or water and the condensation occurs at a relatively constant pressure.

The sub-cooled liquid (also known as a "saturated liquid") may then be routed through an expansion system where the sub-cooled liquid may undergo a significant and abrupt reduction in pressure. The reduction in pressure may result in a flash evaporation of at least a part of the sub-cooled liquid. This flash evaporation may decrease the temperature of the sub-cooled liquid and the vapor/liquid mixture such that it is colder than the temperature of the enclosed space that is to be cooled. The expansion system described above may include an expansion valve, which may also be referred to as a "throttle valve," a pito tube, or any other expansion system known in the art.

Subsequently, the cold vapor/liquid mixture that exited the expansion system may then be routed to the evaporator. Typically, the evaporator contains a tube or a series of coils in which the vapor/liquid mixture is directed. A fan then circulates warm air from the enclosed space that is to be cooled across the coil or tubes of the evaporator that is carrying the cold vapor/liquid mixture. As a result, the warm air evaporates the liquid portion of the of the vapor/liquid mixture. More specifically, the liquid portion of the cold vapor/liquid mixture may extract heat from the surrounding air, thus causing the circulating air to be cooled. Consequently, the temperature of the enclosed space may be lowered to the desired temperature. To complete this a/c vapor cycle, the vapor from the evaporator may again be a saturated vapor, which may then be routed back to the compressor to repeat the foregoing process.

Various examples of a vector component implemented in a vapor cycle a/c system, in accordance with the embodiments, are described below with reference to FIGS. 1-3.

FIG. 1 illustrates a system 100 that may represent an a/c system. The system 100 includes a compressor 102, a vector component 104, which includes an inner core 106 and an outer shell 108, a condenser 110, an expansion system 112, and an evaporator 114. Moreover, the system 100 also includes a circulating working fluid, a fill tube 116, and a bleed tube 118. In various embodiments, the system 100 may be a vapor cycle a/c system. As mentioned previously, the compressor 102 may receive the working fluid as a low-pressure and relatively low temperature saturated vapor or vapor. Once the compressor 102 receives this saturated vapor or vapor, the compressor 102 may compress the low-temperature saturated vapor or vapor into a superheated, compressed vapor. However, instead of the superheated vapor being directed to the condenser 110, as described above and disclosed in previous systems, the superheated vapor may instead be routed to the vector component 104.

The vector component 104 may be a component part of a standard vapor cycle a/c system that is designed to fit between the compressor 102 and the condenser 110. The vector component 104 may cool the superheated, compressed vapor discharged from the compressor 102 to a saturated vapor or a liquid state. The working fluid in the saturated vapor or liquid state may then enter the condenser 110. The condenser 110 may then convert the saturated vapor or liquid, or a combination thereof, received from the vector component 104 into a liquid by directing the saturated vapor or liquid through a coil or tubes within the condenser 110. As the saturated vapor or liquid passes through the coil or tubes, cool water or cool air flowing across the coil or tubes may cause the entire amount of the saturated vapor or liquid to be condensed into liquid form. During condensation, the saturated vapor or liquid flowing through the condenser 110 may reject heat from the system 100 and the rejected heat may be carried away by either the water or the air, whichever is used by the system 100. In other words, heat associated with the saturated vapor or liquid may be absorbed by, and/or transferred to the cool air or cool water, thus causing most or all of the saturated vapor or liquid to transform into a liquid.

By increasing the amount of saturated vapor or liquid in the condenser 110, the heat energy transfer from the working fluid to the air or water stream passing through the condenser 110 may be substantially increased. Therefore, since the working fluid is a saturated vapor or a liquid as it is routed to the condenser 110, the condenser 110 need not convert a superheated vapor into a liquid. Instead, the condenser 110 may only need to condense a saturated vapor or a combination of a saturated vapor and a liquid into a liquid. Accordingly, since less energy will be required to condense the working fluid into a liquid, the efficiency of the condenser 110 may be increased by a significant amount.

As stated above, the condensed, saturated liquid may then be passed through the expansion system 112, where the saturated liquid undergoes an abrupt reduction in pressure. In various embodiments, the reduction in pressure may cause a flash evaporation of at least a part of the saturated liquid. Therefore, the decrease in pressure experienced with respect to the expansion system 112 may cause the saturated liquid to be converted into a mixture of a liquid and a vapor. Additionally, the flash evaporation may also lower the temperature of the liquid and vapor mixture such that the temperature of the mixture is colder than the enclosed space to be cooled.

The cold mixture described above may then be routed through a coil or tubes within the evaporator 114. Furthermore, the evaporator 114 may circulate the warm air in the enclosed space across the coil or tubes of the evaporator 114 that is carrying the cold liquid/vapor mixture. As a result, the warm air may evaporate the liquid portion of the liquid/vapor mixture and, simultaneously, the circulating air may be cooled. As a result, the temperature of the enclosed space may be decreased to a desired temperature. Subsequently, the vapor from the evaporator 114 may be directed back to the compressor 102 to repeat the process described above.

In one embodiment, the increased efficiency of the condenser 110 may also have a net effect on the ability of the evaporator 114 to transfer heat from the air stream flowing through the evaporator 114 to the working fluid of the system 100. Moreover, the vector component 104 may maintain a low compression ratio and a high heat rejection within the compressor 102. Consequently, under both standard operating and high heat conditions, a stable thermal condition throughout the system 100, such as a vapor cycle a/c system, may also be maintained. Further, since the vector component 104 increases the efficiency of both the condenser 110 and the evaporator 114, inclusion of the vector component 104 in the system 100 increases the overall efficiency and cooling capacity of the system 100 and allows the system 100 to be operated using a lesser volume of the circulating working fluid.

As shown in FIG. 1, the vector component 104 may include the inner core 106 and the outer shell 108. In various embodiments, the inner core 106 of the vector component 104 may include one or more capillary tubes. However, it is contemplated that any number of capillary tubes may be included within the inner core 106 of the vector component 104. Moreover, the one or more capillary tubes may be referred to as a capillary tube array. As previously mentioned, the superheated, compressed vapor that exited the compressor 102 may enter the vector component 104. Upon entering the vector component 104, the superheated vapor may be forced through the set of capillary tubes within the inner core 106 of the vector component 104. By confining the superheated vapor into one or more capillary tubes, flow characteristics and various energies associated with the superheated vapor may be more easily controlled. That is, since the superheated vapor may be separated into separate and smaller flows within the set of capillary tubes, the energies existing in each of the separate flows may be monitored and controlled more efficiently. In addition, an increased amount of heat can be extracted from the array of capillary tubes as opposed to the superheated vapor being passed through a larger, standard tube.

For instance, in various embodiments, an example of an energy existing in each of the separate flows of the superheated vapor may be an acoustic event. More particularly, a spontaneous acoustic event may occur while the superheated vapor is being transported through each of the capillary tubes of the inner core 106 of the vector component 104. Further, at the midpoint of the capillary tube array of the inner core 106, the spontaneous acoustic event may occur as the superheated vapor is cooled to a saturated vapor and close to a liquid state as it discharges from the vector component 104. This spontaneous acoustic discharge, along with any other energy known in the art, may assist and/or accelerate the heat energy transfer from within the capillary tube array of the inner core 106 to the outer shell 108 of the vector component 104. Such a heat energy transfer may allow the superheated vapor to be cooled to a saturated vapor near a liquid state or a liquid state as the working fluid leaves the vector component 104 and enters the condenser 110. Due to the accelerated heat transfer and the increase in surface area associated with the capillary tube array, heat loading within the vector component 104 may be kept at a minimum.

Moreover, by separating a single fluid flow (i.e., the superheated vapor) from the compressor 102 into a capillary tube array within the inner core 106 of the vector component 104, a change in the fluid flow characteristics of the superheated vapor may occur. This change in the fluid flow characteristics may cause energies to exist within the center of the fluid flow within each capillary tube of the capillary tube array. That is, separating the superheated vapor into multiple different flows may cause the fluid flow characteristics of each flow of superheated vapor to have energies existing within the center of each flow. These energies may assist the heat energy associated with the superheated vapor to travel at an accelerated rate from the center of the fluid flow to the outer fluid boundaries within each capillary tube. This may allow the overall heat rejection from the capillary tube array to the sub-cooled liquid in the outer shell 108 of the vector component 104 to happen at an accelerated rate, which may cause the vector component 104 to be more efficient.

In an example embodiment, the outer shell 108 of the vector component 104 may surround the inner core 106 of the vector component 104. Moreover, the outer shell 108 of the vector component 104 may allow metered and sub-cooled liquid from the discharge side of the condenser 110 to fill the tube containing the capillary tube array (i.e., the inner core 106). In one embodiment, this sub-cooled liquid from the discharge side of the condenser 110 may be transported via the fill tube 116. Moreover, a fill rate associated with a rate in which the outer shell 108 is filled with the sub-cooled liquid may be controlled by a metered capillary tube sized for the desired fill rate. Therefore, the fill tube 116 that extends from the discharge side of the condenser 110 to the outer shell 108 of the vector component 104 may allow for the outer shell 108 to be filled with sub-cooled liquid.

Since the capillary tube array of the inner core 106 may be transporting a superheated vapor and the outer shell 108 may be filled with a sub-cooled liquid, heat may transfer from the superheated vapor in the capillary tube array to the sub-cooled liquid. Accordingly, as heat energy transfers from the capillary tube array of the inner core 106 of the vector component 104 to the sub-cooled liquid in the outer shell 108 of the vector component 104, the sub-cooled liquid may be heated and expand to a vapor. This vapor may then be expelled from the outer shell 108 of the vector component 104 to a suction or entry side of the compressor 102. In one embodiment, the resulting vapor may travel through the bleed tube 118, which may couple the outer shell 108 of the vector component 104 to the suction side of the compressor 102. In the above embodiment, the bleed tube 118 may be metered and sized for a specific flow rate.

In one embodiment, both the sub-cooled liquid that flows through the fill tube 116 from the discharge side of the condenser 110 to the outer shell 108 of the vector component 104 and the vapor that flows through the bleed tube 118 from the outer shell 108 to the suction side of the compressor 102 may be metered. Metering each of these tubes may help in sustaining a desired level of the sub-cooled liquid within the outer shell 108 of the vector component 104. Maintaining such a level may maximize the heat energy transfer from the superheated vapor traveling through the capillary tube array to the sub-cooled liquid in the outer shell 108 of the vector component 104. In addition, maintaining a particular level of the sub-cooled liquid may also prevent a saturated vapor or liquid from exiting the bleed tube 118 that flows to the suction side of the compressor 102.

That is, the compressed, superheated vapor that exited the compressor 102 may enter the vector component 104 and be directed into the capillary tube array within the inner core 106. Once the superheated vapor is converted to a fluid and exits the vector component 104, the fluid may then be routed to the condenser 110. Sub-cooled liquid discharged from the condenser 110 may then be routed through a metered capillary tube, such as the fill tube 116, into the outer shell 108 of the vector component 104. Accordingly, the outer shell 108 of the vector component 104 may be filled with a sub-cooled liquid. As the sub-cooled liquid enters and passes through the outer shell 108, the sub-cooled liquid may absorb the heat associated with the superheated vapor travelling through each of the capillary tubes within the inner core 106 of the vector component 104. In addition, various energies may then be transfused from the superheated vapor to the sub-cooled liquid in the outer shell 108. As a result, exposure to the heat extracted from the superheated vapor may cause the sub-cooled liquid within the outer shell 108 to become a vapor. Subsequently, as the sub-cooled liquid is transformed into a vapor, the vapor may exit the outer shell 108 of the vector component 104 through the bleed tube 118. The bleed tube 118 may then transfer the vapor from the outer shell 108 to the side of the compressor 102 that receives the superheated vapor. Accordingly, the vapor that exited the outer shell 108 may then be routed to the compressor 102 and the above process may be repeated.

In an example embodiment, the system 100 may also include a sub-cooler. The sub-cooler may be situated between the condenser 110 and the expansion system 112. In one embodiment, the sub-cooler may receive the saturated vapor or vapor and cool the saturated vapor or vapor to the sub-cooled liquid. Subsequently, the sub-cooler may route the sub-cooled liquid to the outer shell 108 of the vector component. The sub-cooled liquid may be transported via a tube similar to the fill tube 116 and/or the bleed tube 118. Moreover, the tube carrying the sub-cooled liquid from the sub-cooler to the outer shell 108 of the vector component may also be metered so that a desired amount of sub-cooled liquid may be maintained in the outer shell 108. Accordingly, the sub-cooler may keep the thermal overload of the compressor 102 to a minimum.

Maintaining the sub-cooled liquid in the outer shell 108 of the vector component 104 and/or the vector component 104 converting the superheated vapor that exited the condenser 110 into a liquid may significantly reduce costs associated with building and maintaining vapor cycle a/c systems. For example, vapor cycle a/c systems that include the vector component 104 may efficiently cool an enclosed space using a much lesser volume of the working fluid, as compared to vapor cycle a/c systems that do not include the vector component 104. Moreover, it is contemplated that the cost savings associated with having a lesser amount of the working fluid may outweigh the costs associated with manufacturing and/or implementing the vector component 104 into a vapor cycle a/c system. Accordingly, vapor cycle systems that incorporate the vector component 104 may be less costly to build, manufacture, maintain, and/or run.

Figure 2:
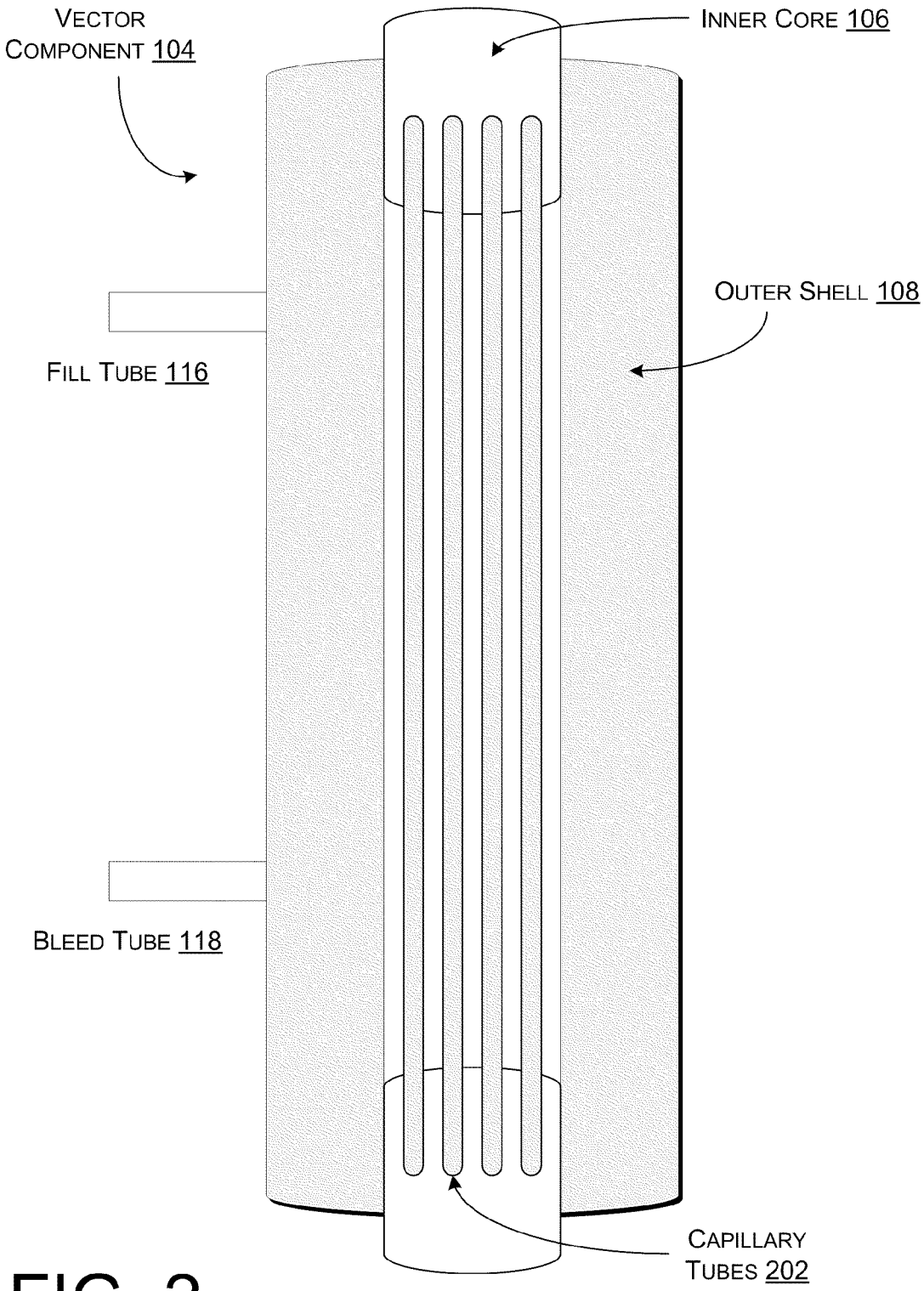
FIG. 2 illustrates a diagram showing an interior portion of the vector component, in accordance with various embodiments.

FIG. 2 illustrates a diagram showing the interior of the vector component 104 that may be incorporated in a vapor cycle a/c system. In various embodiments, the vector component 104 may be the same vector component 104 as illustrated in FIG. 1. As shown, the vector component 104 includes the inner core 106, the outer shell 108, capillary tubes 202, the fill tube 116, and the bleed tube 118.

As discussed above in reference to FIG. 1, the vector component 104 may receive compressed, superheated vapor discharged from the compressor 102. Upon entering the vector component 104, the superheated vapor may be directed into the inner core 106. More particularly, the superheated vapor may be routed into one or more capillary tubes 202 included within the inner core 106 of the vector component 104. Although four capillary tubes 202 are illustrated in FIG. 2, it is contemplated that any number of capillary tubes 202 may be included within the inner core 106. In addition, the collection of capillary tubes 202 may also be referred to as a capillary tube array.

The inner core 106 of the vector component 104 may include the capillary tubes 202 for a variety of reasons. For instance, routing the superheated vapor discharged from the compressor 102 through the capillary tubes 202 allows for the vector component 104 to more efficiently control and contain energies associated with, and produced by, the superheated vapor. That is, the vector component 104 may better be able to monitor and control the energies associated with the superheated vapor when the superheated vapor is confined to a smaller area, such as within one of the capillary tubes 202. Therefore, the vector component 104 may be able to control and/or monitor energies associated with the superheated vapor when the superheated vapor is distributed into multiple different capillary tubes 202. On the contrary, directing the entire amount of the superheated vapor through a single tube may make it more difficult to control the larger amount of energy associated with a larger volume of the superheated vapor.

Furthermore, the outer shell 108 of vector component 104 may surround the inner core 106. As stated above with respect to FIG. 1, the vector component 104 may convert the superheated vapor that exits the compressor 102 into a liquid that may be routed to the condenser 110, which then may discharge a sub-cooled liquid. In various embodiments, this sub-cooled liquid may be routed back to the outer shell 108 of the vector component 104 through the fill tube 116. As a result, the outer shell 108 that surrounds the inner core 106 of the vector component 104 may be filled with the sub-cooled liquid.

As the superheated vapor is forced through the capillary tubes 202, heat associated with the superheated vapor may be extracted and/or absorbed by the sub-cooled liquid contained in the outer shell 108. In other words, since the capillary tubes 202 may be surrounded by the sub-cooled liquid, which may have a much lower temperature than the superheated vapor, it logically follows that the superheated vapor may lose heat to the colder, surrounding environment. Accordingly, the superheated vapor within the capillary tubes 202 may be condensed to a liquid and the sub-cooled liquid contained in the outer shell 108 of the vector component 104 may be heated to a vapor. The fluid that previously existed as the superheated vapor may then exit the vector component 104 and be routed to the condenser 110. Furthermore, the vapor, which previously existed as the sub-cooled liquid, may then be discharged from the outer shell 108 and routed to the suction side of the compressor 102 via the bleed tube 118. Subsequently, the discharged vapor may enter the compressor 102 to repeat this process. In various embodiments, the fill tube 116 and/or the bleed tube 118 may be metered so that a desired amount of sub-cooled liquid or vapor may exist in the outer shell 108 of the vector component 104.

As stated previously, incorporating the vector component 104 into a vapor cycle a/c system may decrease the amount of working fluid needed for the system. In fact, the cost savings associated with having a smaller amount of working fluid may outweigh the costs associated with manufacturing and/or incorporating the vector component 104 into the vapor cycle a/c system. Moreover, the vector component 104 may also increase the efficiency of both the condenser 110 and the evaporator 114 of the vapor cycle a/c system. Therefore, inclusion of the vector component 104 may increase the overall efficiency of a standard vapor cycle a/c system.

Figure 3:
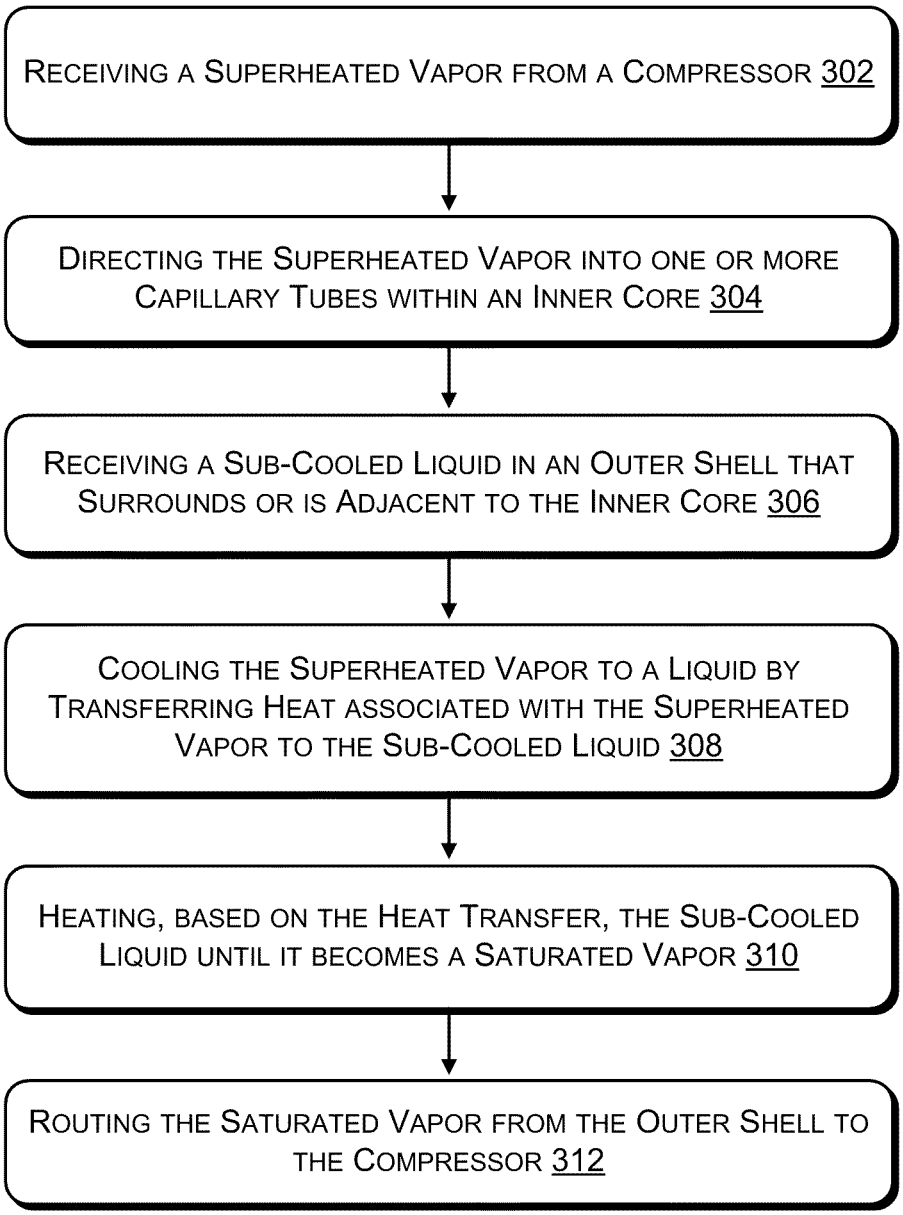
FIG. 3 illustrates a flowchart showing operations for increasing the efficiency of an a/c system using a vector component, in accordance with various embodiments.

FIG. 3 describes various example systems and/or processes corresponding to the vector component described with respect to FIGS. 1 and 2. The example processes are described in the context of the environment of FIGS. 1 and 2, but are not limited to those environments. The order in which the operations are described in each example process is not intended to be construed as a limitation, and any number of the described blocks can be combined in any order and/or in parallel to implement each process. Moreover, the blocks in FIG. 3 may be operations that can be implemented in a vapor cycle a/c system.

FIG. 3 is a flowchart illustrating a method of heating and cooling a working fluid within a system. It is contemplated that the operations set forth below may be performed by or at the vector component described above with respect to FIGS. 1 and 2 (vector component 104). In particular, block 302 illustrates receiving a superheated vapor from a compressor. As stated above, a compressor may be a component of an a/c system and may correspond to compressor 102, as shown in FIG. 1. In one embodiment, the compressor may receive a saturated vapor or vapor and compress the saturated vapor or vapor to create a superheated vapor, which may have a higher temperature and a higher pressure than the saturated vapor. The superheated vapor may then be discharged by the compressor and received by the vector component. In this embodiment, the vector component may be incorporated in a vapor cycle a/c system between the compressor and a condenser. In this embodiment, the condenser may correspond to condenser 110, as shown in FIG. 1.

Block 304 illustrates directing the superheated vapor into one or more capillary tubes within an inner core. It is contemplated that the capillary tubes may correspond to the capillary tubes 202 and the inner core may correspond to inner core 106. Moreover, the capillary tubes (also referred to as a capillary tube array) are included within the inner core of the vector component and any number of capillary tubes may be present. In one embodiment, instead of the superheated vapor being directed into any portion of the vector component, the superheated vapor may be forced into the capillary tubes. As stated previously, by directing the superheated vapor into the capillary tube array, the vector component may have increased control over the energies and/or heat associated with the superheated vapor.

Block 306 illustrates receiving a sub-cooled liquid in an outer shell that surrounds or is adjacent to the inner core. In various embodiments, the outer shell may correspond to outer shell 108 and the outer shell may be adjacent to and/or surround the inner core of the vector component. Moreover, the sub-cooled liquid may be received from a condenser through a fill tube that extends from the discharge side of the condenser to the outer shell of the vector component. The fill tube may correspond to fill tube 116, as shown in FIGS. 1 and 2, respectively. As discussed previously, the liquid that exited the vector component may be received by the condenser, where the liquid is cooled by first routing the liquid into a coil or tubes within the condenser and then by flowing cool air or cool water across the coil or tubes. As a result, the liquid is transformed into a sub-cooled liquid, which is then discharged from the condenser. Further, since the fill tube passes the sub-cooled liquid to the outer shell of the vector component, the fill tube may be metered so that a desired amount of the sub-cooled liquid can be maintained within the outer shell.

Block 308 illustrates cooling the superheated vapor to a liquid by transferring heat associated with the superheated vapor to the sub-cooled liquid. As stated above, when entering the vector component, the superheated vapor may be at a temperature much higher than that of the sub-cooled liquid. Therefore, since the sub-cooled liquid surrounds and/or is adjacent to the superheated vapor within the capillary tubes, heat associated with the superheated vapor may be transferred to, or absorbed by, the sub-cooled liquid of the outer shell. Furthermore, as the superheated vapor loses heat to the surrounding environment (i.e., the sub-cooled liquid), the temperature of the superheated vapor may decrease. Therefore, as the superheated vapor cools, the superheated vapor may then condense into a liquid. As mentioned previously, the resulting liquid may exit the capillary tubes and the vector component and subsequently be routed to the condenser.

Block 310 illustrates heating, based on the heat transfer, the sub-cooled liquid until it becomes a saturated vapor. With respect to block 308, the superheated vapor may be cooled to a liquid since heat associated with the superheated vapor is transferred to, or absorbed by, the sub-cooled liquid contained in the outer shell of the vector component. In various embodiments, the sub-cooled liquid may be simultaneously heated to a higher temperature. More particularly, as the sub-cooled liquid absorbs the heat associated with the superheated vapor, it logically follows that the temperature of the sub-cooled liquid may increase and at least a portion of the sub-cooled liquid may expand into a saturated vapor. Consequently, the outer shell of the vector component may then include a mixture of sub-cooled liquid and saturated vapor.

Block 312 illustrates routing the saturated vapor from the outer shell to the compressor. As discussed above with respect to block 310, heat may be transferred from the superheated vapor within the capillary tubes of the inner core to the sub-cooled liquid contained in the outer core of the vector component. In an example embodiment, the resulting saturated vapor contained in the outer shell of the vector component may be discharged from the outer shell and routed to the compressor. More particularly, the saturated vapor may exit the outer shell of the vector component via a bleed tube (i.e., bleed tube 118) that is also coupled to the entry side of the compressor. Therefore, the saturated vapor discharged from the outer shell may enter the compressor, where it may then be compressed to form a compressed, superheated vapor. This superheated vapor may again be routed to the vector component and the process described above can be repeated. It is contemplated that the bleed tube may also be metered so that an amount of saturated vapor exiting the outer shell of the vector component may be controlled and/or monitored.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

The invention claimed is:

1. An air-conditioning system comprising:

a compressor that receives a saturated vapor and compresses the saturated vapor into a second vapor having a higher temperature and a higher pressure;

a vector component that cools the second vapor discharged from the compressor into a liquid, the vector component including an inner core that includes one or more capillary tubes and an outer shell that is adjacent to the inner core, and the second vapor being routed through the one or more capillary tubes; and a condenser that receives the liquid and routes the liquid through a coil or tubes exposed to a flow of air or water to create a sub-cooled liquid, the liquid rejecting heat from the air-conditioning system and the rejected heat being carried away by the air or the water, and the sub-cooled liquid being discharged from the condenser and being routed to the outer shell of the vector component that is filled with the sub-cooled liquid.

2. The air-conditioning system as recited in claim 1, wherein the vector component is incorporated into the air-conditioning system between the compressor and the condenser.

3. The air-conditioning system as recited in claim 1, wherein:

heat is transferred from the second vapor within the one or more capillary tubes to the sub-cooled liquid in the outer shell; and the heat transfer causes the second vapor to expand into the liquid.

4. The air-conditioning system as recited in claim 3, wherein:

the heat transferred to the sub-cooled liquid causes at least a portion of the sub-cooled liquid to expand to the saturated vapor; and the saturated vapor is routed from the outer shell to an entry point of the compressor.

5. The air-conditioning system as recited in claim 4, wherein:

the sub-cooled liquid is routed from the condenser to the outer shell through a fill tube;

the saturated vapor is routed from the outer shell to the compressor through a bleed tube; and the fill tube or the bleed tube is metered so that a desired level of the sub-cooled liquid can be maintained.

6. The air-conditioning system as recited in claim 1, wherein inclusion of the vector component increases an efficiency of or reduces a cost of, manufacturing or maintaining the air-conditioning system.

7. The air-conditioning system as recited in claim 5, wherein the outer shell is re-filled with the sub-cooled liquid from the condenser when it is determined that the saturated vapor is routed from the outer shell to the compressor through the bleed tube.

8. A method comprising:

directing a superheated vapor received from a compressor into a capillary tube array that includes one or more capillary tubes, the capillary tube array being included within an inner core of a vector component;

surrounding the capillary tube array with a sub-cooled liquid having a temperature lower than the superheated vapor, the sub-cooled liquid being contained in an outer shell of the vector component that is adjacent to or that surrounds the inner core;

transferring heat from the superheated vapor to the sub-cooled liquid to convert the superheated vapor to a liquid that is to be output; and heating, based at least in part on the heat transfer from the superheated vapor to the sub-cooled liquid, at least a portion of the sub-cooled liquid to a vapor.

9. The method as recited in claim 8, further comprising transferring the vapor to the compressor utilizing a bleed tube.

10. The method as recited in claim 8, further comprising routing the sub-cooled liquid from a condenser to the outer shell via a fill tube.

11. The method as recited in claim 10, further comprising metering the fill tube so that a desired amount of the sub-cooled liquid can be maintained in the outer shell.

12. The method as recited in claim 8, wherein the transferring and the heating include absorbing, by the sub-cooled liquid, heat associated with the superheated vapor.

13. The method as recited in claim 8, wherein the vector component is incorporated into an air-conditioning system between the compressor and the condenser.

14. The method as recited in claim 13, wherein inclusion of the vector component increases an efficiency of, or reduces a cost of, manufacturing or maintaining the air-conditioning system.

15. A device comprising:

an inner core that receives a compressed, superheated vapor from a compressor and directs the superheated vapor into one or more capillary tubes;

an outer shell surrounding the inner core that is capable of containing a sub-cooled liquid that lowers a temperature of the superheated vapor such that the superheated vapor is converted into a liquid that is output to a condenser, at least a portion of the sub-cooled liquid being expanded to a vapor based at least in part on heat transferred from the superheated vapor within the one or more capillary tubes to the outer shell;

a fill tube coupled to the outer shell that facilitates transfer of the sub-cooled liquid from the condenser to the outer shell; and a bleed tube coupled to the outer shell that facilitates transfer of the vapor from the outer shell to a compressor.

16. The device as recited in claim 15, wherein:

the fill tube and the bleed tube are metered; and the outer shell is re-filled with the sub-cooled liquid from the condenser when the vapor is discharged from the outer shell via the bleed tube.

17. The device as recited in claim 15, wherein the device is a vector component incorporated in an air-conditioning system between the compressor and the condenser.

18. The device as recited in claim 17, wherein inclusion of the vector component increases an efficiency of, or reduces a cost of, manufacturing or maintaining the air-conditioning system.

* * * * *